US006955742B2

(12) United States Patent
McKay et al.

(10) Patent No.: US 6,955,742 B2
(45) Date of Patent: Oct. 18, 2005

(54) REMOVABLE SHOWER STRIP FOR A PAPERMAKING MACHINE

(75) Inventors: Edward T. McKay, Agawam, MA (US); Karl J. Lemme, Blandford, MA (US)

(73) Assignee: AstenJohnson, Inc., Charleston, SC (US)

( * ) Notice: Subject to any disclaimer, the term of this patent is extended or adjusted under 35 U.S.C. 154(b) by 27 days.

(21) Appl. No.: 10/382,141

(22) Filed: Mar. 5, 2003

(65) Prior Publication Data

US 2004/0173330 A1 Sep. 9, 2004

(Under 37 CFR 1.47)

(51) Int. Cl.[7] ..... D21F 1/32

(52) U.S. Cl. ..... 162/275; 162/199; 162/274; 134/122 R; 239/554; 239/566; 239/568; 239/602

(58) Field of Search ..... 162/195, 199, 162/255, 261, 264, 272–279, 286, 310, 353; 239/548, 554, 566, 568, 602; 134/122 R

(56) References Cited

U.S. PATENT DOCUMENTS

| | | | | | |
|---|---|---|---|---|---|
| 2,642,314 | A | * | 6/1953 | Dupasquier | 239/120 |
| 3,432,383 | A | * | 3/1969 | Russell | 162/272 |
| 3,617,441 | A | * | 11/1971 | Farrell | 162/199 |
| 4,616,489 | A | * | 10/1986 | Wood et al. | 68/200 |
| 4,698,134 | A | * | 10/1987 | Green et al. | 162/199 |
| 4,785,986 | A | * | 11/1988 | Daane et al. | 242/615.11 |
| 6,053,978 | A | * | 4/2000 | Bernert | 118/325 |
| 6,502,434 | B1 | * | 1/2003 | Doelle | 68/205 R |

* cited by examiner

*Primary Examiner*—Eric Hug
(74) *Attorney, Agent, or Firm*—Volpe and Koenig, P.C.

(57) ABSTRACT

A shower device for a papermaking machine is provided which includes a longitudinally extending hollow member having an inlet end adapted for connection to a pressurized water source. A slot extends longitudinally along at least a portion of the hollow member. The slot includes opposing edges and a strip of material is slideably engageable with the hollow member so that the hollow member is substantially sealed along the edges of the slot when the strip is installed. The strip of material includes a plurality of spaced apart shower nozzles. This allows a plurality of shower nozzles on a papermaking machine to be quickly and easily replaced by slidably removing the nozzle strip from the slot and slidably inserting a replacement strip of nozzles into the slot.

19 Claims, 4 Drawing Sheets

REMOVABLE SHOWER STRIP FOR A PAPERMAKING MACHINE

BACKGROUND

The present invention relates to a shower device for use in connection with a papermaking machine, and more particularly is directed to a shower device having a series of nozzles mounted on a pipe or header oriented across the width of the machine and fabric thereon.

Numerous showers are used in a papermaking machine to keep the various fabrics and other surfaces clean by removing fibers and other contaminants, and to lubricate the fabrics and fabric bearing surfaces. These known showers are generally comprised of a series of nozzles mounted on pipes which are oriented across the width of the machine and fabric, i.e., in the cross-machine direction (CD). Typically, the nozzles are mounted on a metal pipe capable of accommodating high pressures of water (from between 40 and 150 psi for lubricating showers, up to 300–400 psi for needle showers) and are generally spaced at about 3-inch to 6-inch centers. The nozzles may be welded to the pipe or threaded to allow for replacement.

In use, the nozzles spray cleaning liquid such as water and various chemicals onto the fabric and/or rolls of the papermaking machine to remove fibers and/or contaminants and to provide lubrication. If one or more of these shower nozzles becomes blocked, it is no longer able to provide the desired beneficial effects at that location. This may lead to uneven drainage or degradation of other fabric properties which can result in marking on the sheet of paper being formed thereon, and to premature fabric wear, both of which are generally undesirable.

To correct this situation, the blocked nozzles in these prior art showers must be removed and replaced or cleaned. It is generally not practical to do this while the machine is in operation, as the shower pipe must be disconnected at each side of the machine and then removed. There is also a danger of loose parts or tools falling into the machine and, unless the shower pipe is located inside another (e.g., a split pipe), it is very difficult to remove it without causing damage to the machine, fabric or sheet.

It has also been known to provide a shower brush inside of the shower pipe. This can be a rotary or reciprocating brush having bristles which contact and clean the inside orifices of the nozzles. These brushes have proven to be somewhat effective, but are sometimes unable to clear a blocked nozzle.

Thus, there is a need for a device which will facilitate the removal of a shower pipe and/or enable simple and fast replacement of the nozzles without having to shut down the papermaking machine.

SUMMARY

Briefly stated, the present invention provides a shower device for a papermaking machine. The shower device includes a longitudinally extending hollow member having an inlet end adapted for connection to a pressurized water source. A slot extends longitudinally along at least a portion of the hollow member. The slot includes opposing edges. A strip of material is slideably engageable with the hollow member so that the hollow member is substantially sealed along the edges of the slot when the strip is installed. The strip of material includes a plurality of spaced apart shower nozzles.

In a further aspect of the invention, at least one strip holder is provided on the hollow member along the edges of the slot or attached to the hollow member along the edges of the slot. Preferably, one of the strip holder and the strip with the nozzles is made of elastically deformable material. Preferably, the strip is formed by a polymeric material and is preferably one of polyethylene, polyetheretherketone (PEEK), polyphenylene sulphide (PPS); or any other suitable polymeric material.

In one embodiment which is presently preferred, the hollow member is a water delivery pipe for the shower which is made of metal and is slit along its entire length to form the slot. Other types of hollow members are possible. The strip holder is preferably incorporated into the hollow member at the slit and preferably includes a pair of dovetail grooves or other form of locking groove machined into the exterior and/or interior of the hollow member. Alternatively, the strip holder may be formed by a fitting which is adapted to fit over the slit in the pipe and may be held there by any suitable means, such as mechanical fasteners, welding, or any other suitable type of connection.

In one aspect of the invention, the nozzle strip is formed of a polymeric material in which a plurality of shower nozzles have been inserted in a linear arrangement and which is adapted to fit tightly into the strip holder on the hollow member so as to provide a fluid-tight seal. The connection between the nozzle strip and strip holder is designed to accommodate the high water pressures to which the shower is exposed without leaking. Additionally, the material is elastically deformable to allow it to be slid in place in the strip holder and maintain a tight seal when acted upon by the high pressure water in the hollow member.

In one embodiment, the shower nozzles are arranged linearly along the length of the strip of material and are molded into position in the polymer. Alternatively, the shower nozzles may be removably mounted by tapping suitably sized holes to accommodate a threaded shower nozzle housing. Various other nozzled mounting arrangements are possible to connect the nozzles to the nozzle strip, and the invention is not limited to any particular method. The nozzle strip may, optionally, be reinforced by means of adding a reinforcing material such as a thin strip of stainless steel so as to add strength and rigidity to the nozzle strip, if necesary. Such reinforcement will preferably be embedded within the polymeric material during manufacture but it may also be attached to the exterior of the nozzle strip.

Preferably, a brush is located inside the hollow member and is attached to reciprocating or rotating means to periodically clean and remove debris from the interior of the shower nozzles as well as the interior of the hollow member.

In accordance with the invention, the shower device may be stationary or reciprocating. Additionally, the shower device may be located at any location on a papermaking machine where shower devices are normally located, such as in the forming, pressing and/or drying sections of the machine, as necessary in order to clean or lubricate the rolls and/or fabrics or doctors and other stationary and rotating equipment in the paper machine.

While the preferred embodiment of the shower device is used to deliver water, any other suitable fluid may be utilized that is used for showering fabrics and/or rolls and can include various chemicals and/or chemical mixtures for cleaning and/or conditioning fabrics, roll covers, rolls or other components within the papermaking machine.

BRIEF DESCRIPTION OF THE DRAWING(S)

The foregoing summary as well as the following detailed description of the preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangement shown. In the drawings.

DETAILED DESCRIPTION OF THE PREFERRED EMBODIMENT(S)

The present invention will be described with reference to the accompanying drawing figures, wherein like numerals represent like elements throughout. As used herein, the terms "a" and "one" refer to one or more of the referenced item, unless specifically noted otherwise. Additionally, the term "cross-direction" refers to the direction which extends across a papermaking machine, parallel to the rolls which carry a papermaking fabric.

Figure 1:
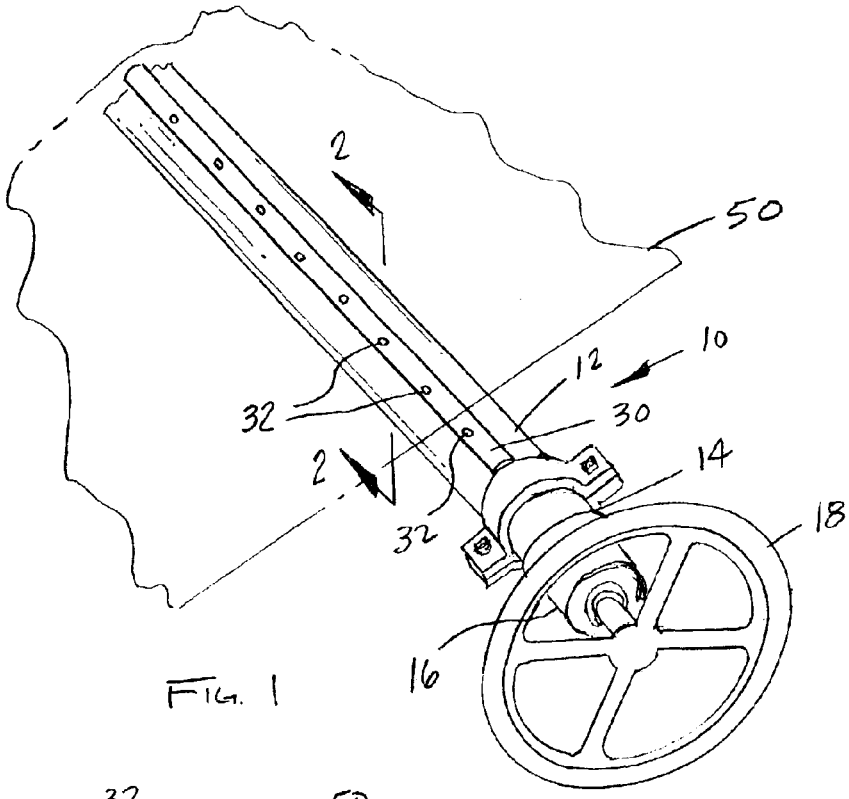
FIG. 1 is a perspective view of a shower device in accordance with the present invention.
Figure 2:
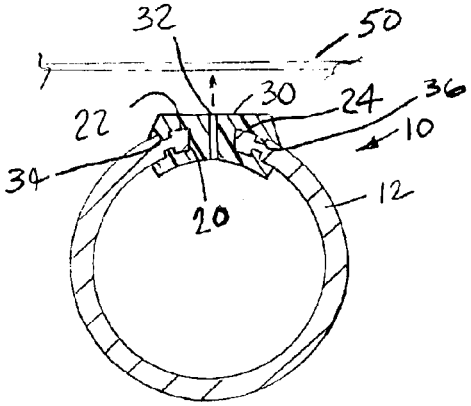
FIG. 2 is a cross-sectional view taken along line 2—2 in FIG. 1.

Referring now to FIGS. 1 and 2, a shower device 10 in accordance with the present invention is shown. The shower device 10 preferably includes a hollow member 12 that extends across the width of a papermaking machine. The hollow member 12 has an inlet end 14 which is adapted for connection to a pressurized water source (not shown), and preferably includes a valve 16 with an actuation wheel or lever 18 to control or stop the flow of pressurized water to the hollow member 12.

As shown in FIG. 2, a slot 20 is formed in the hollow member 12 and extends generally longitudinally along at least a portion of the hollow member 12. The slot 20 has opposing edges 22, 24.

In a preferred embodiment, the hollow member 12 is a pipe and the slot 20 is formed by a slit extending longitudinally through a sidewall of the pipe 12. In a preferred embodiment, the pipe 12 is made of a metallic material and has sufficient wall thickness and strength to hold water at pressures of up to about 400 psi. Since in accordance with the invention the slot 20 extends along the length of the pipe or hollow member 12, external reinforcements can be attached to the hollow member 12 to prevent the internal pressure from causing the hollow member 12 to expand or open at the slot 20. These reinforcements can be in the form of welded plate reinforcements or any other suitable structure.

As shown in FIGS. 1 and 2, a strip of material 30 is slideably engageable with the hollow member 12 so that the hollow member 12 is substantially sealed along the edges 22, 24 of the slot 20 when the strip 30 is installed. The strip of material 30 includes a plurality of spaced apart shower nozzles 32, which may be formed by openings molded or formed into the strip 30 or may be attached to the strip 30 (hereinafter referred to as the "nozzle strip 30"), as explained in further detail below. The nozzles 32 are preferably oriented towards a papermaking fabric 50 (shown in phantom lines in FIGS. 1 and 2) so that a spray of high-pressure cleaning liquid is directed at the papermaking fabric 50. Depending upon the location of the shower device 10 in the papermaking equipment, it can have the nozzles oriented in various different directions in order to clean a desired surface of the papermaking fabric 50 or oriented in a direction generally towards the rolls or roll covers in order to clean fibers or other contaminants from the fabric 50 or other parts of the papermaking machine. Additionally, various spray patterns can be provided for the nozzles.

Figure 4:
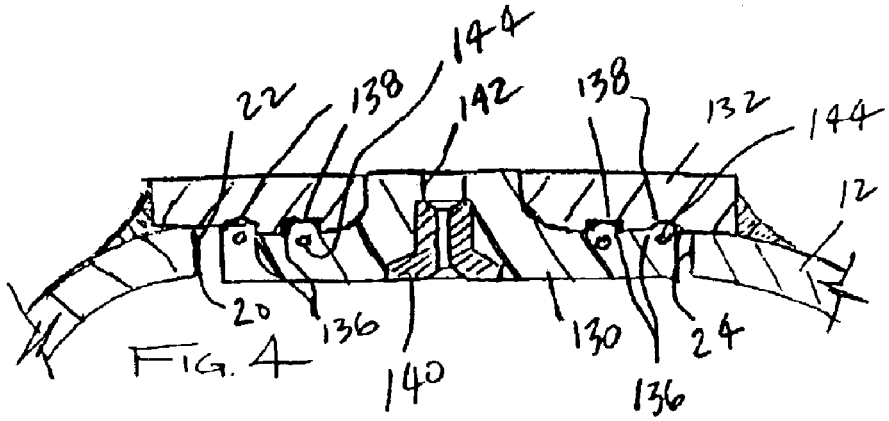
FIG. 4 is an enlarged cross-sectional view, similar to FIG. 3, showing a third embodiment of a nozzle strip in accordance with the present invention.

In a first preferred embodiment, as shown in FIG. 2, a strip holder is at least one of formed in the hollow member 12 along the edges 22, 24 of the slot 20, or attached to the hollow member 12 along the edges of the slot 20, for example as shown in FIG. 4. In the first preferred embodiment of the invention shown in FIG. 2, the strip holder is formed in the hollow member 12 as grooves 34 that extend generally parallel to the edges 22, 24 of the slot 20. These grooves 34 can be on both the inside and outside surfaces of the hollow member 12, as shown in FIG. 2, or can be provided on only one or the other of the inner and outer surfaces of the hollow member 12.

In the first preferred embodiment, the nozzle strip 30 is made of an elastically deformable polymeric material, such as polyethylene, polyetheretherketone (PEEK), polyphenylene sulphide (PPS), or any other suitable polymeric material. Other suitable non-polymeric materials could also be utilized. The elasticity allows the nozzle strip 30 to deform slightly to allow for easier installation, since it can have a length of 8 to 10 meters. The nozzle strip 30 may optionally be reinforced by addition of a reinforcing means to the strip exterior. This may be done by embedding within the polymeric material or attaching by suitable means to the nozzle strip exterior, a thin strip of metal, such as stainless steel, so as to add strength and rigidity to the strip, if necessary. Preferably, such reinforcement is added to the strip during manufacture. Preferably, the nozzle strip 30 is extruded and/or machined to have the desired cross-section. The nozzle strip 30 preferably has a generally H-shaped cross-section. However, other cross-sections, such as a generally I or inverted T-shaped cross-section can be used. Preferably, complementary projections 36 are formed on the nozzle strip 30 which are engaged in the grooves 34 to provide additional structural support along the edges 22, 24 of the slot 20 to keep the edges 22, 24 of the slot 20 from spreading under pressure and to maintain a fluid tight seal.

In the first preferred embodiment of the invention, the nozzles 32 are formed as openings in the nozzle strip 30. The nozzle strip 30 is preferably removably insertable by sliding it longitudinally into or out of the slot 20 in order to allow the nozzles 32 to be removed and cleaned or for another nozzle strip 30 with new nozzles to be quickly and easily installed. Water pressure acting on the inner surface of the nozzle strip 30 in the hollow member 12 forces it against the inner surface of the hollow member 12 to form a generally water-tight seal. This seal may be enhanced based on the elasticity of the nozzle strip 30.

Figure 3:
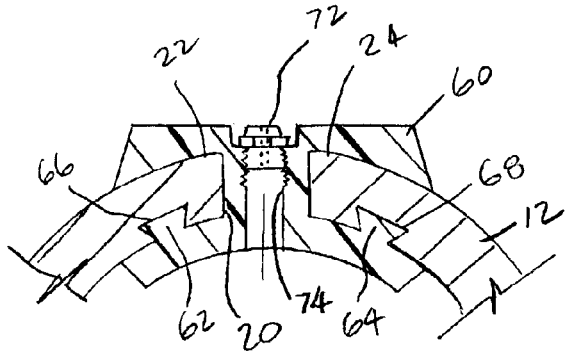
FIG. 3 is an enlarged cross-sectional view of a second embodiment of a removable nozzle strip for the shower device in accordance with the present invention.

Referring now to FIG. 3, a second embodiment of the nozzle strip 60 for use in the shower device 10 in accordance with the present invention is shown. The nozzle strip 60 includes two generally longitudinally extending dovetail-shaped projections 62, 64 which are received in corresponding recesses 66, 68 on the inner surface of the hollow member 12 which form the strip holder. This interlocking connection provides further structural support to prevent the edges 22, 24 of the slot 20 from spreading when the hollow member 12 is pressurized. As in the first embodiment shown in FIG. 2, the nozzle strip 60 preferably overlaps both the inner surface and outer surface of the hollow member 12 along the edges 22, 24 of the slot 20 to provide for a generally fluid tight seal.

Still with reference to FIG. 3, preferably nozzles 72 are threadably connected to openings 74 in the nozzle strip 60 to allow for easy replacement of individual nozzles 72 rather than replacement of an entire nozzle strip, such as the nozzle strip 30 of the first embodiment, when only a few nozzles need replacement.

Referring now to FIG. 4, a third preferred embodiment of the nozzle strip 130 is shown. The nozzle strip 130 is preferably installed in a strip holder which is formed as a fitting 132 that is attached to the hollow member 12 along the edges 22, 24 of the slot 20. The strip holder fitting 132 is preferably made of a metallic material that may be welded, bolted, mechanically fastened or connected to the hollow member 12 in any reliable manner which will provide a watertight connection between the hollow member 12 and the strip holder fitting 132. The nozzle strip 130 is preferably formed with a plurality of parallel projections 136 which are received in corresponding longitudinally extending grooves 138 formed in the strip holder fitting 132. Forming the strip holder as a separate part allows the grooves 138 to be more easily machined in a separate operation prior to installing the strip holder fitting 132 on the hollow member 12. Those skilled in the art will recognize that the number and shape of the grooves can be varied in order to provide a firm, sealing connection between the nozzle strip 130 and the strip holder fitting 132. Additionally, the nozzle strip 130 can act as a structural support and the projections 136 and grooves 138 may be designed to provide an interlocking connection to prevent the edges 22, 24 of the slot 22 from spreading apart in use.

Still with reference to FIG. 4, the nozzles 140 are preferably pre-formed pieces which may be made of steel, ceramic, pyrex glass or ruby, which are pressed or molded in place into openings 142 formed in the nozzle strip 130. Preferably, the flared edges of the nozzles 140 face inwardly into the hollow member 12 such that water pressure presses the nozzles 140 firmly in place in the nozzle strip 130.

The nozzle strip 130 is preferably molded of a polymeric material, and may include reinforcements such as metal or fiber inserts 144, which are molded into the strip 130 in order to provide structural reinforcement.

Figure 5:
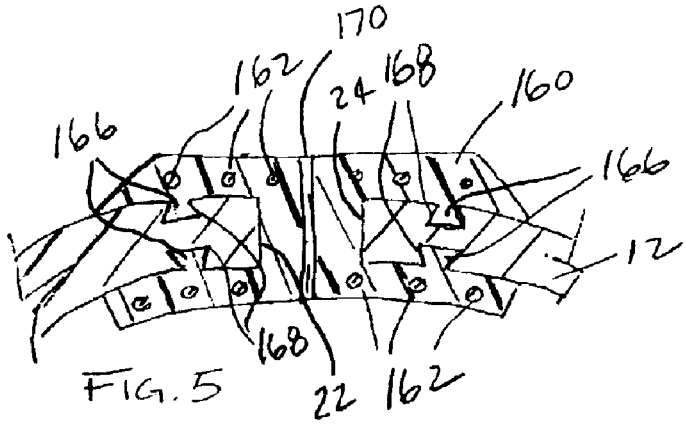
FIG. 5 is a cross-sectional view showing a fourth embodiment of a nozzle strip in accordance with the present invention.

Referring now to FIG. 5, a fourth preferred embodiment of the nozzle strip 160 is shown. The fourth preferred embodiment of the nozzle strip 160 is similar to the first preferred embodiment, as shown in FIG. 2, and further includes reinforcements 162 molded into the nozzle strip 160 in a similar manner to that discussed above in connection with the third embodiment. Preferably, dovetail-shaped projections 166 are provided on the nozzle strip 160 in complementary positions to dovetail-shaped grooves 168 that extend longitudinally both on the inner surface and outer surface of the hollow member 12 adjacent to the edges 22, 24 of the slot 20. The nozzles 170 are preferably formed as openings in the strip 160.

Figure 6:
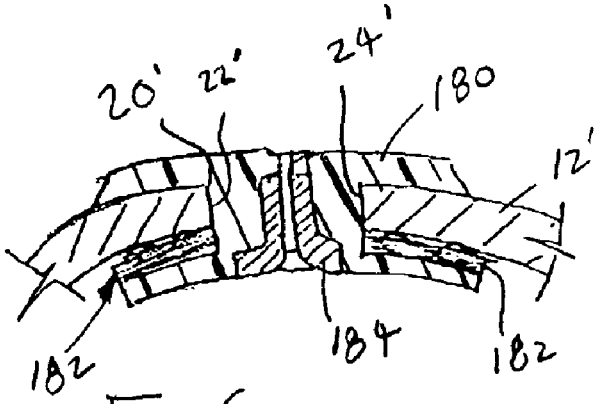
FIG. 6 is a cross-sectional view showing a fifth embodiment of a removable nozzle strip in accordance with the present invention.

Referring now to FIG. 6, a fifth preferred embodiment of the nozzle strip 180 is shown. In the fifth preferred embodiment of the nozzle strip 180, the hollow member 12' has sufficient structural strength that it will not spread under the high pressures encountered during use. Accordingly, grooves are not required on either of the edges 22', 24' of the slot 20'. Preferably, a gasket material 182 is provided on an inner contact surface of the nozzle strip 180 such that it enhances the sealing of the nozzle strip 180 along the edges 22', 24' of the slot 20'. In the fifth preferred embodiment, the nozzles 184 are inserts which are pressed or formed in place in the nozzle strip 180 and may be formed of a ceramic, metallic, pyrex glass, ruby or other synthetic material, as desired.

Figure 7:
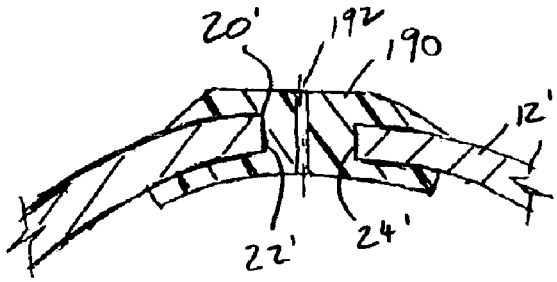
FIG. 7 is a cross-sectional view showing a sixth embodiment of a removable nozzle strip in accordance with the present invention.

Referring now to FIG. 7, a sixth preferred embodiment of the nozzle strip 190 is shown. The nozzle strip 190 is preferably also installed in a hollow member 12' that does not include grooves along the edges 22', 24' of the slot 20', but has sufficient structural rigidity so that the edges 22', 24' do not spread apart in use. The nozzle strip 190 includes nozzles 192 which are formed in the nozzle strip 190. Preferably, the material which forms the nozzle strip 190 is sufficiently flexible to provide a good seal between the nozzle strip 190 and the inner surface of the hollow member 12'.

Figure 8:
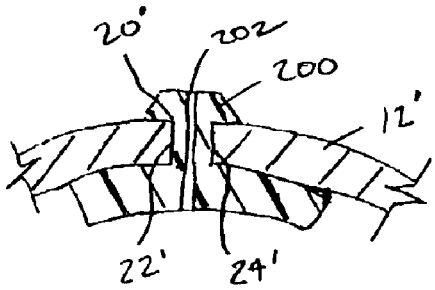
FIG. 8 is a cross-sectional view showing a seventh embodiment of a nozzle strip in accordance with the present invention.

Referring now to FIG. 8, an seventh preferred embodiment of the nozzle strip 200 is shown. The nozzle strip 200 is similar in construction to the nozzle strip 190. However, the nozzle-strip has a generally inverted T-shaped cross-section so that the contact area with the outer surface of the hollow member 12' has been reduced for easier sliding installation of the nozzle strip 200 into position in the slot 20'. Again, the nozzles 202 are preferably formed by openings in the nozzle strip 200.

Figure 9:
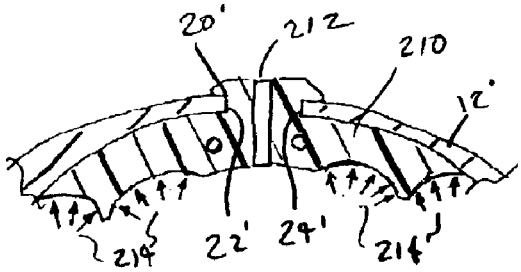
FIG. 9 is a cross-sectional view of an eight embodiment of a nozzle strip in accordance with the present invention.

Referring now to FIG. 9, a eighth preferred embodiment of a nozzle strip 210 is shown. The nozzle strip 210 is similar to the nozzle strip 200. However, the inner surface of the nozzle strip 210 which comes into contact with the high-pressure water within the hollow member 12' is shaped to provide an enhanced sealing effect based on the internal water pressure in the hollow member 12' acting on the inner surface of the nozzle member 210. The pressure (indicated by the small arrows 214) will act generally uniformly over the entire inner surface of the nozzle strip 210. By providing a specific shape or contour to the nozzle member 210 in this area, the internal pressure acts to force the inner flanges of the nozzle strip against the inner surface of the hollow member 12' to provide an enhanced seal.

Figure 10:
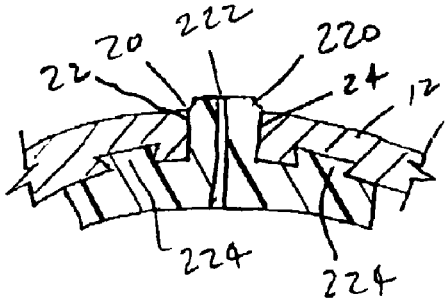
FIG. 10 is a cross-sectional view of a ninth embodiment of a removable nozzle strip in accordance with the present invention.

Referring now to FIG. 10, a ninth preferred embodiment of the nozzle strip 220 is shown. The nozzle strip 220 preferably includes nozzles 222 formed therein. The nozzle strip 220 has a generally inverted T-shaped cross-section so that it does not contact the outer surface of the hollow member 12, providing reduced friction for installing the nozzle strip 220. Preferably, dovetail projections 224 are provided on the nozzle strip 220 and extend parallel to the slot 20. Corresponding grooves 226 are formed in the hollow member 12 along the edges 22, 24 of the slot 20 to provide additional structural support to prevent spreading of the hollow member 12 along the edges 22, 24 of the slot 20.

While the above-referenced embodiments of the nozzle strip all provide a nozzle strip of an elastically deformable material, it is also possible to provide a strip holder which is made from or includes an elastically deformable polymeric material at the nozzle strip contact area to provide enhanced sealing.

Figure 11:
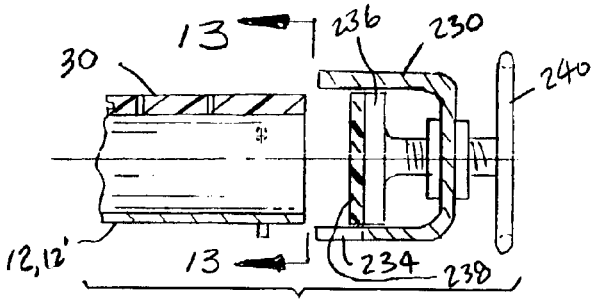
FIG. 11 is a cross-sectional view through the end of a shower device in accordance with the present invention showing a removable end cap for sealing an end of the pipe with a nozzle strip.
Figure 12:
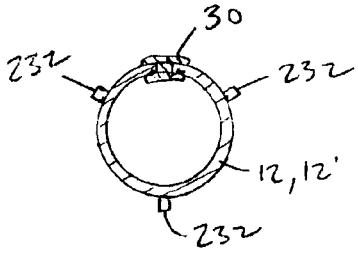
FIG. 12 is a cross-sectional view taken along line 12—12 in FIG. 11.
Figure 13:
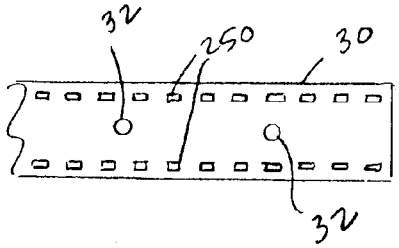
FIG. 13 is a top view of a nozzle strip in accordance with the present invention showing a gripping arrangement for installing and/or removing the nozzle strip.
Figure 14:
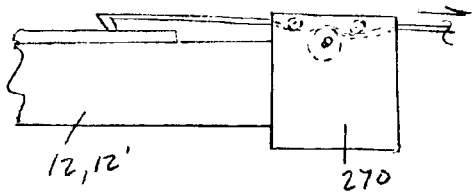
FIG. 14 is a side elevational view showing a pulling device for removing and/or installing nozzle strips in accordance with the present invention.

In order to install the nozzle strip in position, it is necessary that one end of the hollow member 12 be removable. As shown in FIGS. 11 and 12, this can be accomplished using a removable end cap 230 that can be slid onto and off of posts 232 attached to the hollow member 12, 12'. The posts 232 are received in corresponding slots 234 in the end cap 230 which is longitudinally slid over the end of the hollow member 12, 12' and then rotated sideways such that it cannot be withdrawn from its position by pulling in a longitudinal direction without first rotating the end cap 230. A moveable inner pressure member 236, which preferably includes a sealing surface 238, can then be moved inwardly via a hand crank or hand wheel 240 to seal both the end of the hollow member 12, 12' and the end of the nozzle strip, for example the nozzle strip 30 as shown.

In the preferred embodiment, the slot 20, 20' extends longitudinally along generally the entire length of the hollow member and the nozzle strip 30, 60, 130, 170, 180, 190, 200, 210, 220 also extends generally along the entire length of the hollow member 12, 12'. In order to install or replace the nozzle strip when a nozzle becomes plugged, the end cap 230 is removed and the old nozzle strip 30, 60, 130, 170, 180, 190, 200, 210, 220 is withdrawn longitudinally. This can be facilitated through the placement of a plurality of tracks 250 along the outer edges of the strip 30, 60, 130, 170, 180, 190 which can be fed through a traction mechanism 270 which may include a toothed wheel which engages in the slots 250 or a pulling member which engages in the slots 250 in order to withdraw the nozzle strip 30, 60, 130, 170, 180, 190 from the hollow member 12, 12'.

It is also possible to have both ends of the hollow member 12, 12' installed as removable end caps so that a nozzle strip 30, 60, 130, 170, 180, 190, 200, 210, 220 can be installed from one side and removed from the other side to facilitate the replacement process.

In use, a plurality of shower nozzles on a papermaking machine can be replaced by cutting off water pressure to the affected hollow member 12, 12' via the valve 16 and then removing at least one end cap 230 from the hollow member 12, 12'. The nozzle strip 30, 60, 130, 170, 180, 190, 200, 210, 220 is then slideably removed from the strip holder provided around the slot 20, 20' in the hollow member 12, 12'. A replacement strip 30, 60, 130, 170, 180, 190, 200, 210, 220 of nozzles is then slideably inserted into the strip holder to close the slot 20, 20'. The sealing cap 230 on at least one end of the hollow member 12, 12' is then reinstalled and sealed in position to create a watertight seal. Water pressure can then be restored.

Those skilled in the art will recognize that it is also possible to provide a moveable brush within the hollow member 12, 12' such that the brush moves over an inlet side of the nozzles in an attempt to keep the nozzles clean without having to remove the nozzle strip 30, 60, 130, 170, 180, 190, 200, 210, 220 and replace it. However, when a nozzle is plugged, instead of removing the entire hollow member and replacing individual nozzles, the nozzle strip 30, 60, 130, 170, 180, 190, 200, 210, 220 can be easily and quickly removed and replaced while the papermaking machine continues to operate without fear of damage to the papermaking equipment.

Those skilled in the art will recognize that the present invention provides an easy and convenient means for correcting plugged or blocked nozzles in a shower device in a quick and efficient manner without the need for shutting down an entire papermaking machine, which can be accomplished while the papermaking machine continues to run. This allows for faster replacement, which results in less wear of the fabric while maintaining high sheet quality and fabric performance. While the present invention has been described in terms of the preferred embodiments, those skilled in the art recognize that various modifications can be made within the scope of the present invention.

What is claimed is:

1. A shower device for a papermaking machine, comprising:

a longitudinally extending hollow member having an inlet end adapted for connection to a pressurized water source;

a slot extending longitudinally along at least a portion of the hollow member, the slot having opposed edges; and a strip of material slidably engageable with and disengagable from the hollow member so that the hollow member is substantially sealed along the edges of the slot when the strip is installed, the strip of material including a plurality of spaced apart shower nozzles.

2. The shower device of claim 1, wherein the hollow member is a pipe, and the slot is formed by a slit extending longitudinally through a sidewall of the pipe.

3. The shower device of claim 1, wherein a strip holder is at least one of formed in the hollow member along the edges of the slot or attached to the hollow member along the edges of the slot.

4. The shower device of claim 3, wherein the strip holder is formed in the hollow member and includes grooves that extend generally parallel to the edges of the slot.

5. The shower device of claim 3, wherein the strip holder includes a fitting which is attached to the hollow member along the slot, the fitting having generally parallel grooves for receiving the strip.

6. The show device of claim 3, wherein the strip holder is made of an elastically deformable material.

7. The shower device of claim 3, wherein the strip of material is made of an elastically deformable material.

8. The shower device of claim 7 wherein the strip of material further includes a reinforcements means.

9. The shower device of claim 1, wherein the shower nozzles are generally linearly arranged an are generally uniformly spaced apart.

10. The shower device of claim 1, wherein the strip is made of an elastically deformable material.

11. The shower device of claim 1, wherein the shower nozzles are inserted into the strip.

12. The shower device of claim 1, wherein the shower nozzles are formed in the strip.

13. The shower device of claim 1, wherein the shower nozzles are removably connected to the strip.

14. The shower device of claim 1, wherein the strip is formed of a polymeric material.

15. The shower device of claim 14 wherein the strip of material further includes a reinforcement means.

16. The shower device of claim 1, further comprising a movable brush located in the hollow in member, the brush being mounted for movement over an inlet side of the nozzles.

17. The shower device of claim 1, wherein the slot extends longitudinally along generally an entire length of the hollow member, and the strip extends along generally the entire length of the hollow member.

18. A method of replacing a plurality of shower nozzles on a papermaking machine, comprising:

slidably removing a nozzle strip including a plurality of spaced apart nozzles from a slot extending longitudinally along at least a portion of a hollow member having an inlet end adapted for connection to a pressurized water source; and slidably inserting a replacement strip of spaced apart nozzles into the slot.

19. The method of claim 18, further comprising installing a sealing cap on an end of the hollow member to create a fluid tight seal.

* * * * *

UNITED STATES PATENT AND TRADEMARK OFFICE

CERTIFICATE OF CORRECTION

PATENT NO. : 6,955,742 B2
APPLICATION NO. : 10/382141
DATED : October 18, 2005
INVENTOR(S) : McKay et al.

It is certified that error appears in the above-identified patent and that said Letters Patent is hereby corrected as shown below:

IN THE CLAIMS

In claim 6, at column 8, line 44, after the word "The", delete "show" and insert therefor --shower--.

In claim 8, at column 8, line 49, after the words "includes a", delete the "s" from the word "reinforcement".

In claim 16, at column 8, line 66, after the word "hollow", delete the word "in".

Signed and Sealed this

Eleventh Day of July, 2006

JON W. DUDAS
*Director of the United States Patent and Trademark Office*